US008327603B2

(12) United States Patent
Smith

(10) Patent No.: US 8,327,603 B2
(45) Date of Patent: Dec. 11, 2012

(54) FLEXIBLE CLAMP FRAME AND INSTALLATION METHOD FOR WINDOW

(75) Inventor: Mark L. Smith, Buchanan, MI (US)

(73) Assignee: Atwood Mobile Products LLC, Elkhart, IN (US)

( * ) Notice: Subject to any disclaimer, the term of this patent is extended or adjusted under 35 U.S.C. 154(b) by 143 days.

(21) Appl. No.: 12/955,158

(22) Filed: Nov. 29, 2010

(65) Prior Publication Data

US 2012/0131867 A1 May 31, 2012

(51) Int. Cl.
*E06B 3/00* (2006.01)

(52) U.S. Cl. ..... 52/745.16; 52/204.53; 52/213; 52/204.1; 52/656.5; 52/208

(58) Field of Classification Search ..... 52/208, 52/204.53, 213, 217, 745.15, 745.16, 204.1, 52/656.5
See application file for complete search history.

(56) References Cited

U.S. PATENT DOCUMENTS

| | | | | |
|---|---|---|---|---|
| 4,821,472 | A | 4/1989 | Tix | |
| 5,119,609 | A | 6/1992 | Tait et al. | |
| 5,210,986 | A | 5/1993 | Hagemeyer et al. | |
| 5,619,828 | A | 4/1997 | Ver Meer | |
| 5,701,780 | A | 12/1997 | Ver Meer | |
| 5,941,033 | A | 8/1999 | Adams | |
| 6,314,691 | B1 * | 11/2001 | Takagi et al. | 52/220.1 |
| 6,467,226 | B2 | 10/2002 | Dodson et al. | |
| 7,469,509 | B2 * | 12/2008 | Cripe | 52/208 |
| 7,669,382 | B2 | 3/2010 | Burton et al. | |
| 7,752,816 | B2 | 7/2010 | Gunther et al. | |

* cited by examiner

*Primary Examiner* — William Gilbert
*Assistant Examiner* — Patrick Maestri
(74) *Attorney, Agent, or Firm* — Michael A. Myers; Shumaker, Loop & Kendrick, LLP

(57) ABSTRACT

A clamp frame is disclosed for securing a window frame in a building structure opening by hand without using fasteners. The clamp frame comprises a unitary extruded plastic member that defines a cross section having an integrally formed connection element that mates with a complementarily shaped portion of a window frame to connect the clamp frame and the window frame without fasteners along the length of the clamp frame. The cross section includes a clamp element having at least a leg and a lever. The leg and lever are each connected to the connection element by a living hinge and are movable relative to the connection element between an open position and an overlapping locked position, which results in a clamp load holding together the clamp frame and window frame without the use of fasteners. One end of the leg of the clamp element is constantly urged against the building structure by the lever when the clamp element is in the locked position. The clamp frame may be preassembled by hand onto the window frame before shipping to customers.

10 Claims, 5 Drawing Sheets

FLEXIBLE CLAMP FRAME AND INSTALLATION METHOD FOR WINDOW

FIELD OF THE INVENTION

The invention disclosed herein relates to a flexible clamp frame for securing a window frame in an opening of a building structure.

BACKGROUND

When installing window frames in building structures it is necessary to bend, cut, and otherwise shape rigid metal framing elements. Many pieces have to be formed and shipped to the customer. The typical window installation also requires numerous fasteners such as nails, screws, and so forth, which add to production costs and installation time. It would be advantageous to have a flexible unitary clamping device capable of securing a window frame assembly by hand in the opening of a building structure firmly so that external seals compress against the building without the use of fasteners. Such a device would also be able to be preassembled to the frame so that fewer pieces would need to be shipped to the customer.

SUMMARY OF THE INVENTION

The clamp frame of this invention is an all plastic extruded frame that is a flexible unitary structure. One embodiment of the device defines a cross section that includes a connection element for connecting the clamp frame to a window frame and a clamp element having a locking lever and a clamp leg. The locking lever hingedly depends from the connection element. The lever is thus movable relative to the connection element between an open position and a locked position. The clamp leg has a toe with an interior interlock area, against which the lever is brought to bear in the locked position. A radius corner cover may be releasably secured to the clamp frame in a snap on fashion.

An object of the invention is to provide a flexible unitary clamp device for securing by hand a window frame in the opening of a building structure. Related objects and advantages will be apparent from the following description.

DETAILED DESCRIPTION OF INVENTION

Figure 1:
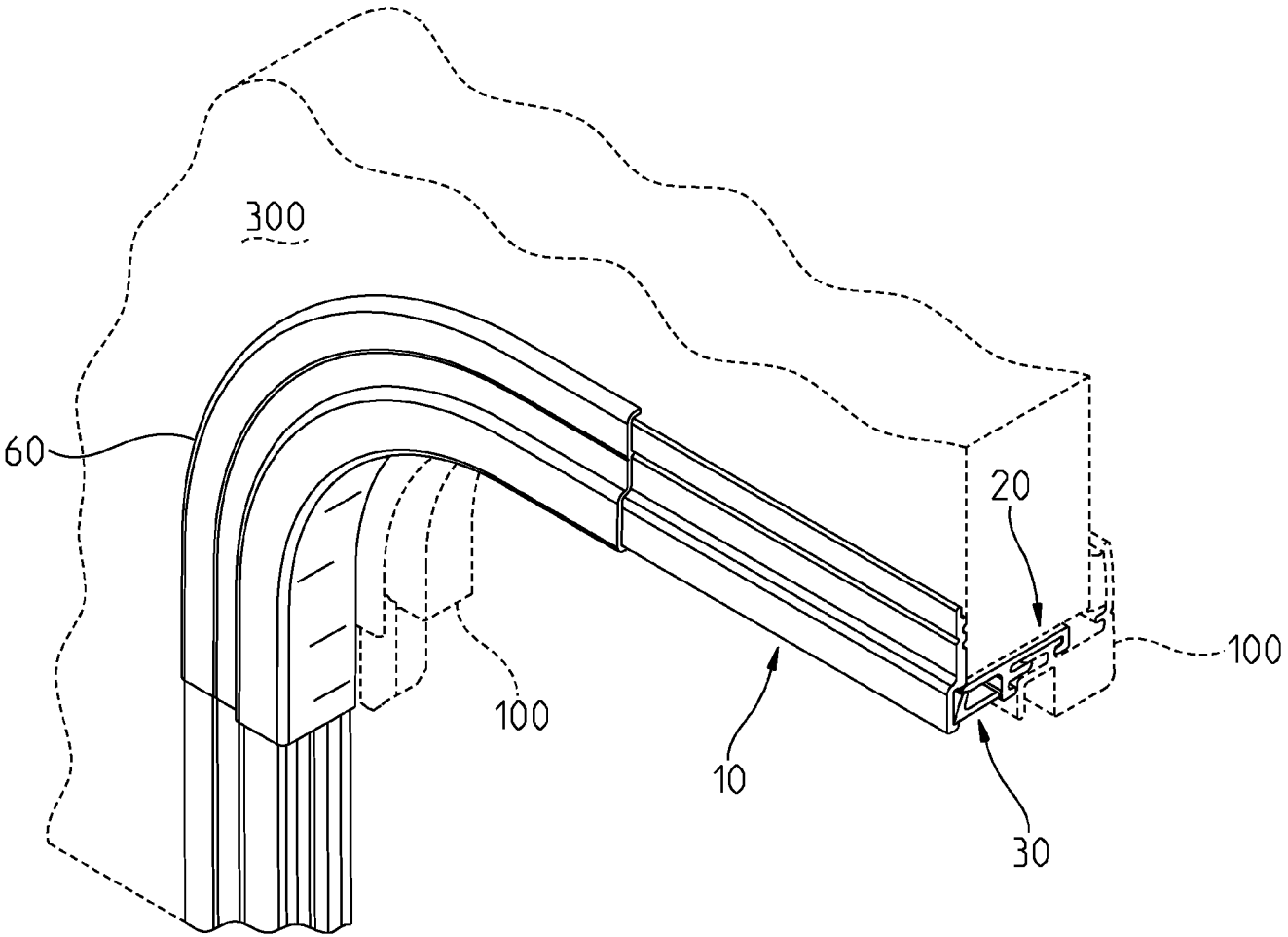
FIG. 1 is an elevated perspective partial cutaway view of an embodiment of the clamp frame and corner cover of the invention shown secured in the opening of a building structure. In each of the figures an exemplary window frame and building structure are shown in phantom.
Figure 2:
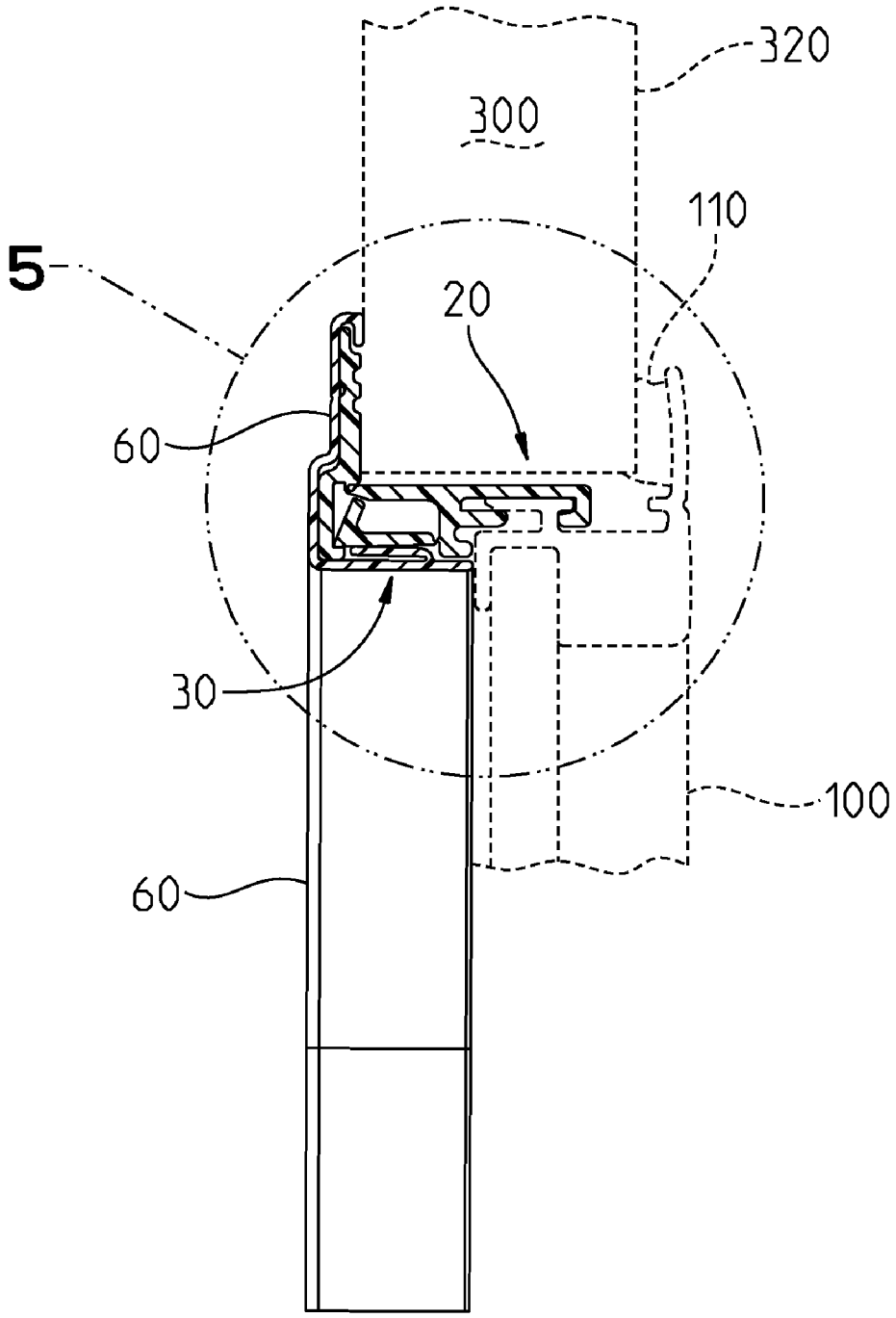
FIG. 2 is a plan view of the front of the clamp frame and corner cover of FIG. 1 illustrating the cross section of an embodiment of the invention with the locking lever in the locked position.

Referring now to the drawings, the clamp frame 10 is capable of securing a window frame 100 in an opening formed in a wall of building structure 300 that has an interior side 310 and an exterior side 320. In the embodiment shown, the clamp frame 10 defines a cross section that includes a connection element 20 for connecting the clamp frame 10 to a window frame 100 and a clamp element 30.

Figure 4:
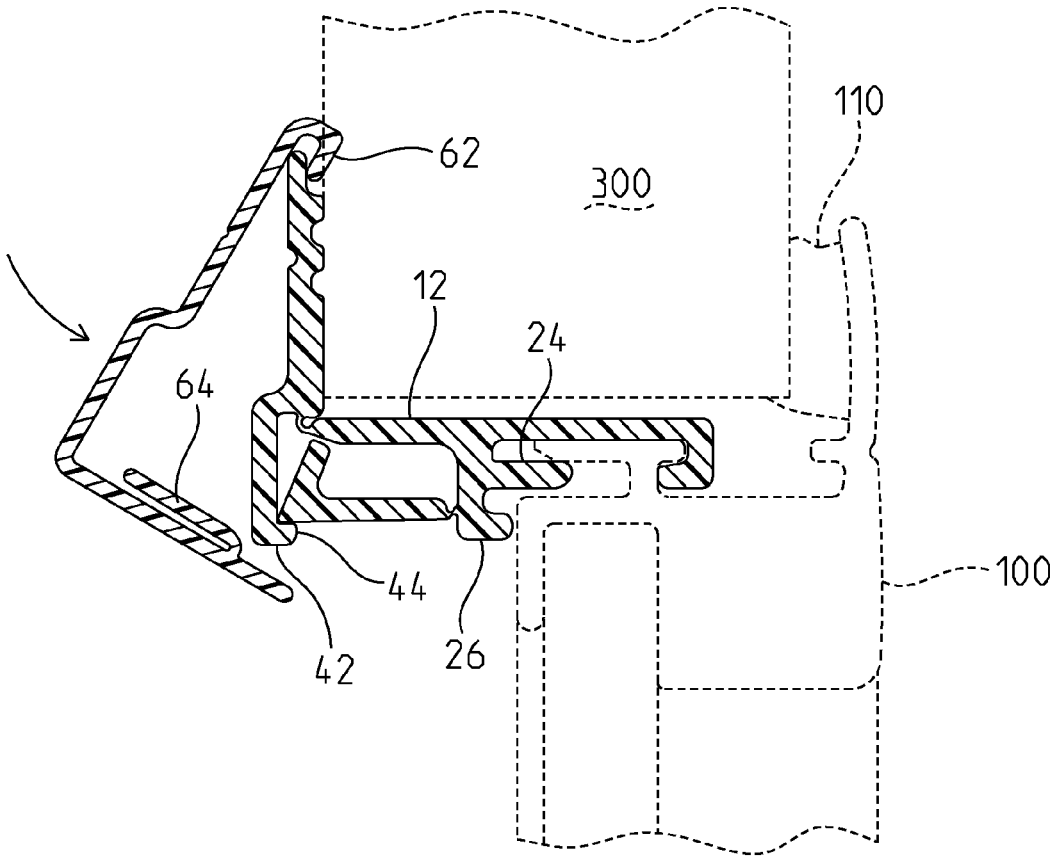
FIG. 4 is an enlarged plan view like the view of FIG. 3 showing an embodiment of the clamp frame with the locking lever in the locked position and with the corner cover partially secured.

The connection element 20 includes a first U-shaped gripping leg 22, a second U-shaped retention leg 24 and a stabilizing leg 26, which extends downward from the retention leg 24, as shown in FIG. 4. The U-shaped gripping and retention legs 22, 24 are oppositely disposed so as to define a space 23 therebetween. It should be understood that other configurations may be constructed such as tongue-and-groove or the like so long as such configuration is complementarily shaped with a portion of the window frame 100 so that the window frame may releasably connect to the clamp frame 10 without fasteners and define a snap fit along the length of the frame 10. In the embodiment illustrated, the configuration defines a T-slot, which receives the T-shaped portion 120 of the illustrative window frame shown throughout the figures.

Figure 3:
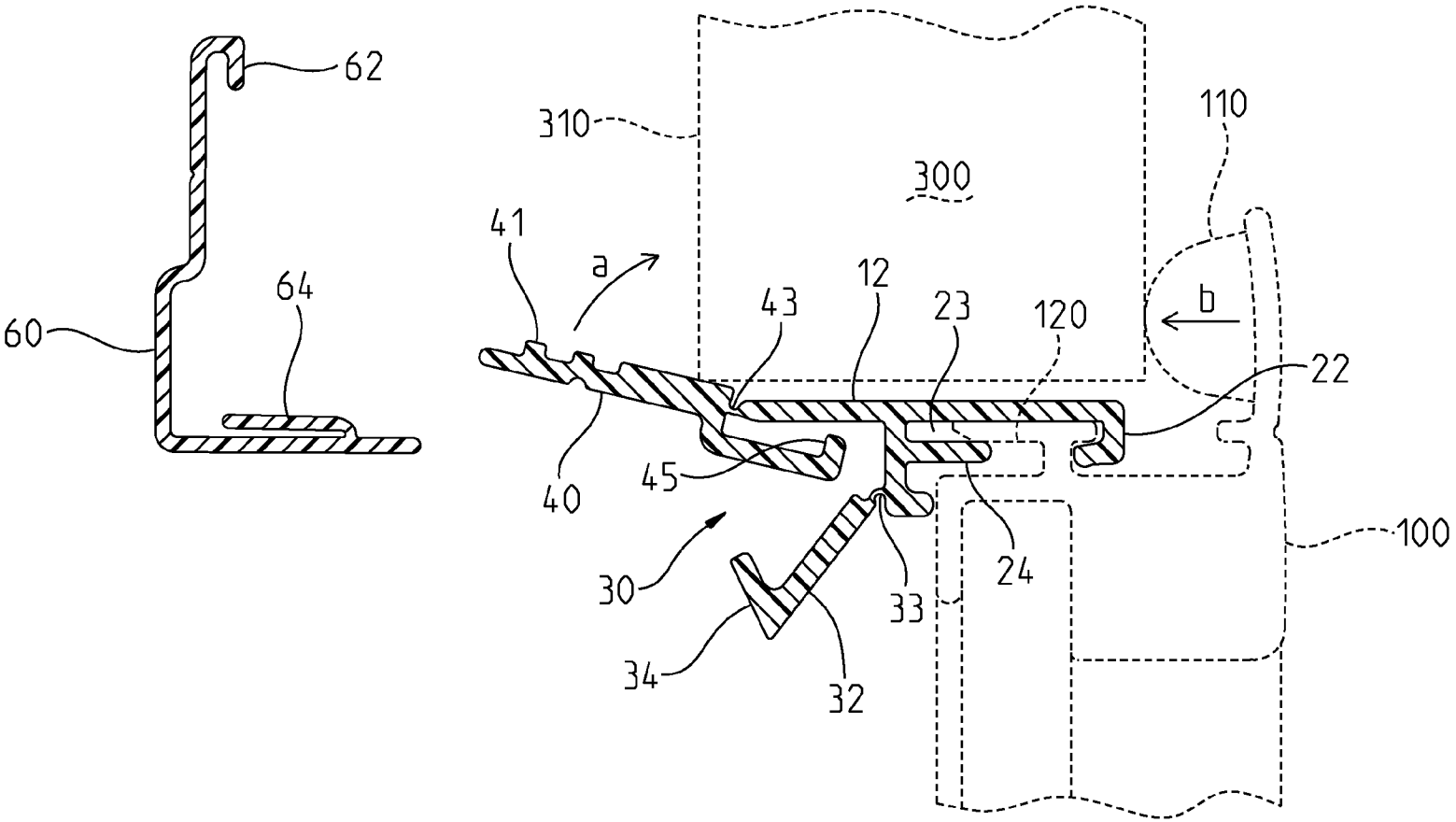
FIG. 3 is an enlarged plan view of an embodiment of the clamp frame and corner cover illustrating only the cross section of the clamp frame with the locking lever in the open position and with the corner cover removed.

The clamp element includes a locking lever 32 and a clamp leg 40. The locking lever 32 hingedly depends from the connection element 20. The locking lever 32 includes an angled arm 34 and is connected to the connection element 20 at the stabilizing leg 26, as shown in FIG. 3. Clamp element 30 also includes clamp leg 40. Clamp leg 40 has grips 41, a toe 42 and an interior interlock area 45.

In one embodiment, clamp leg 40 is configured in an upstanding attitude relative to the body 12 of the clamp frame 10 and connected rigidly to the connection element 20 so that it may not pivot or move relative to the connection element 20. In the preferred embodiment, however, clamp leg 40 is connected to the connection element 20 by way of living hinge 43 so that clamp leg 40 can move between an open position (FIG. 3) and a closed locked position (FIG. 4).

The clamp frame 10 is formed, preferably, from extruded plastic so that it's capable of folding and flexing as described below without breaking. Radius corner cover 60 is preferably made from the same or similar plastic material used to form clamp frame 10 and includes a hook portion 62 and a locking leg 64. The radius corner cover 60 may be molded or vacuum formed to provide a finished look to the clamp frame 10 after installation.

In use, installation of a window is more efficient than with conventional aluminum clamp frames because the inventive clamp frame 10 doesn't need to be shaped at the job site or secured to the building structure with screws. Instead, the clamp frame 10 is extruded from plastic and so, it is an elongated unitary flexible piece. The clamp frame may be cut once and releasably secured to the window frame 100 before shipping the assembly to the customer. To assemble, the T slot defined by the gripping and retention legs 22, 24 is mated with the T-shaped portion 120 of the window frame 100 so that the T-shaped portion 120 is received in the space 23 of the clamp frame 10.

The gripping leg 22 and retention leg 24 are flexed to snap fit onto the T portion 120 of the window frame 100 along the length of the clamp frame 10, as shown in FIGS. 1 and 3. Hence, screws or other types of fasteners typically used to connect the clamp frame and the window frame are unnecessary since the new clamp frame 10 utilizes a "hook" engagement into the window frame extrusion.

Next, as shown in FIGS. 3-4, the clamp leg 40 is rotated upward in the direction of the arrow a so that grips 41 abut the interior side 310 of the building structure 300 and the clamp leg is in a generally upstanding attitude relative to the body 12. In one embodiment, for example, the angle formed by the body 12 and the clamp leg 40 is between about eighty and one-hundred degrees. In another embodiment, the angle is between about eighty-five and ninety-five degrees; and, in another embodiment, the angle formed by the body 12 and the clamp leg 40 is about ninety degrees. These structures as well as its completely plastic composition, allows the clamp frame 10 to function equally well despite slight variations in wall thickness. Unlike metal frame clamps heretofore available, the inventive clamp frame 10 is "forgiving."

To lock the clamp securely in place, the locking lever 32 is rotated upwardly so that the angled arm 34 slides against the side 44 of toe 42 into the locked position, as shown in FIG. 4. As this sliding occurs the locking lever 32 provides incrementally increasing clamp load for pulling the window frame in the direction depicted by the arrow b (FIG. 3) so that the window frame seal 110 is brought to bear and is compressed against the building structure with force that increases incrementally as the arm 34 slides against the side 44 of toe 42 as the locking lever 32 is moved into the locked position (see FIG. 4). The toe end of the clamp leg 40 is constantly urged against the building structure 300 by the locking lever when it's in the locked position.

The building structure contemplated in this description is most preferably that of a recreational vehicle. It should be understood, however, that the clamp frame 10 may be used in connection with other similarly "light" building structures such as mobile or modular homes or the like. The inventive concepts disclosed in the embodiments described herein may also be applied to heavier structures, namely residential homes and commercial buildings.

Figure 5:
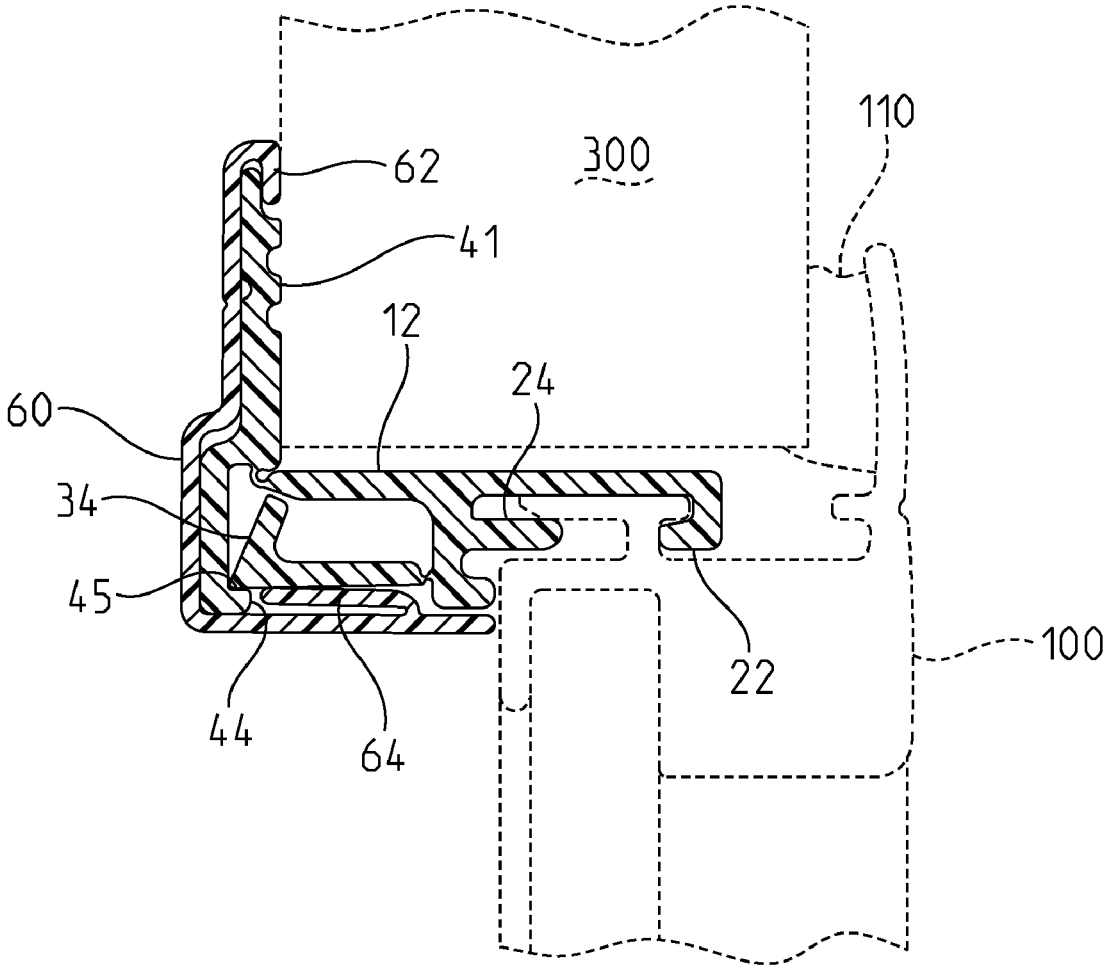
FIG. 5 is an enlarged plan view like the view of FIG. 4 showing an embodiment of the clamp frame with the locking lever in the locked position and with the corner cover secured to the clamp leg.

The radius corner cover 60 is releasably secured to the clamp leg 40, as shown in FIG. 4. The hook 62 is positioned over the top lip of the upper end of the clamp leg 40 and force is applied in the direction of the arrow until the locking leg 64 slides beyond the length of toe 42 and snaps into place, as shown in FIG. 5.

The unitary flexible clamp frame 10 offers the advantages of no shaping, cutting, or bending as is required with current aluminum extruded Z-shaped clamp frames. Additionally, because of the clamping action of the locking lever 32 and its angled arm 34 the compression load incrementally displaced on the window frame holds the window in the opening and compresses the seal 110 without any fasteners. Another advantage of the plastic material for the flexible clamp frame 10 is that it may be manufactured in color. Aluminum extrusions must be painted after manufacture.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes, or devices, and any further applications of the principles of the invention as described herein, are contemplated as would normally occur to one skilled in the art to which the invention relates.

What is claimed is:

1. A method of securing a window frame in an opening formed in a building structure having an interior side and an exterior side, the method comprising the following steps:

providing a flexible unitary elongated clamp frame that defines a cross section having an integrally formed connection element, and an integrally formed clamp element, the clamp element includes a clamp leg and locking lever, at least the locking lever is connected to the connection element by a living hinge;

mating the connection element with a complementarily shaped portion of a window frame to connect the clamp frame and the window frame along the length of the clamp frame without fasteners;

positioning at least the window frame and the clamp frame assembly in an opening formed in a building structure having an interior side and an exterior side; and, folding the locking lever at its hinge into the clamp leg until the lever is brought to bear against an interlock area of the clamp leg, wherein the clamp leg is constantly urged against the interior side of the building structure by the lever when the clamp element is in a locked position.

2. The method of claim 1, including the step of snap-fitting a radius corner cover to the clamp frame.

3. A clamp frame for securing a window frame that includes a seal in an opening formed in a building structure having an interior side and an exterior side, the clamp frame defines a cross section comprising: a connection element for connecting said device to the window frame, and a clamp element having a locking lever and a clamp leg, the locking lever hingedly depends from the connection element, said lever is movable relative to the connection element between an open position and a locked position, and the clamp leg has a toe with an interior interlock area against which the lever is brought to bear in the locked position, wherein the locking lever includes an angled arm.

4. A clamp frame according to claim 1, further comprising a radius corner cover removably secured thereto.

5. A clamp frame according to claim 1, wherein the connection element comprises a gripping leg, a retention leg, and a space therebetween to define a T slot extending the length of the device for receiving a T shaped portion of a window frame.

6. A clamp frame according to claim 1, wherein the angled arm is configured such that it forms an acute angle relative to the locking lever such that said angled arm slides against a side of said toe opposite the interior interlock area and provides incrementally increasing clamp load for pulling the window frame in a direction so that said window frame seal is brought to bear against the building structure with force that increases incrementally with the sliding of the arm against the side of the toe as the locking lever is moved into the locked position.

7. A clamp frame according to claim 1, wherein the clamp leg hingedly depends from the connection element and is movable relative to the connection element between an open position when the window frame is not secured in said opening and a closed position when the window frame is secured in the opening and the locking lever is in the locked position, wherein said clamp element forms a lock so that no fasteners are needed to secure the window frame in said opening.

8. A clamp frame for securing a window frame in an opening formed in a building structure having an interior side and an exterior side, the clamp frame comprising: a flexible unitary elongated member that defines a cross section having an integrally formed connection element that mates with a portion of a window frame to connect the clamp frame and the window frame without fasteners along the length of the clamp frame, the cross section of the clamp frame further comprising a clamp element having at least a leg and a lever, the leg and lever hingedly depend from the connection element and are movable relative to said connection element between an open position and an overlapping locked position, one end of the leg of the clamp element is constantly urged against the building structure by the lever when the clamp element is in the locked position.

9. A clamp frame according to claim 8, further comprising a radius corner cover removably secured thereto.

10. A clamp frame according to claim 8, wherein the lever includes an angled arm that slides against said leg and provides incrementally increasing clamp load for pulling the window frame in a direction so that a window frame seal is brought to bear against the building structure with force that increases incrementally as the arm slides against the leg as the locking lever is moved into the locked position.

* * * * *